US005988795A

United States Patent [19]

Suetsugu et al.

[11] Patent Number: 5,988,795

[45] Date of Patent: Nov. 23, 1999

[54] ELECTROSTATIC INK JET RECORDING APPARATUS PREVENTING PRECIPITATION OF CHARGED PARTICULATE MATERIAL IN INK LIQUID

[75] Inventors: Junichi Suetsugu; Yoshihiro Hagiwara; Hitoshi Minemoto; Ryosuke Uematsu; Kazuo Shima, all of Tokyo, Japan

[73] Assignee: NEC Corporation, Japan

[21] Appl. No.: 08/738,337

[22] Filed: Oct. 25, 1996

[30] Foreign Application Priority Data

Oct. 26, 1995 [JP] Japan ..... 7-278694

[51] Int. Cl.[6] ..... B41J 2/06

[52] U.S. Cl. ..... 347/55

[58] Field of Search ..... 347/55, 112, 141

[56] References Cited

U.S. PATENT DOCUMENTS

| | | | |
|---|---|---|---|
| 4,478,510 | 10/1984 | Fujii et al. | 347/55 |
| 4,717,926 | 1/1988 | Hotomi | 347/55 |
| 4,943,818 | 7/1990 | Hotomi | 347/55 |

FOREIGN PATENT DOCUMENTS

| | | | |
|---|---|---|---|
| 703080A2 | 3/1996 | European Pat. Off. | 347/55 |
| 61-57343 | 3/1986 | Japan | 347/55 |
| 63-74083 | 4/1988 | Japan . | |
| 5-281694 | 10/1993 | Japan . | |
| 8174815 | 7/1996 | Japan | 347/55 |
| 2031344 | 4/1980 | United Kingdom | 347/55 |
| 93/11866 | 6/1993 | WIPO . | |

OTHER PUBLICATIONS

*Patent Abstracts of Japan*, vol. 14, No. 416, Sep. 1990 & JP 02 160557, Jun. 20, 1990.

Patent Abstracts of Japan, vol. 6, No. 241, (P158) Nov. 30, 1982, JP–A–57–139759 (Konishiroku Shashin Kogyo KK).

Patent Abstracts of Japan, vol. 6, No. 241, (P158), Nov. 30, 1982, JP–A–57–139760 (Konishiroku Shashin Kogyo KK).

*Primary Examiner*—John Barlow
*Assistant Examiner*—C. Dickens
*Attorney, Agent, or Firm*—Ostrolenk, Faber, Gerb & Soffen, LLP

[57] ABSTRACT

An electrostatic ink jet according to the present invention includes a head body having an ink chamber for holding ink liquid containing charged particulate material; an ejection port provided at one end of that head body and connecting to the ink chamber; an ejection electrode arranged near this ejection port and fed with an ejection voltage of the same polarity as the charge characteristic of the charged particulate material; a counter electrode arranged opposite to the ejection port via a recording medium; and a pair of stirring electrodes. The stirring electrodes are arranged in the direction reverse to that of gravity in the ink chamber. The stirring electrodes are fed with a stirring voltage for shifting the charge particulate material in the direction reverse to the direction of gravity, and that stirring voltage is generated before the generation of the ejection voltage. As a result, the toner particulates are prevented from precipitating before the ejection of ink, and their concentration in the ink liquid in the ink chamber is generally uniformized.

37 Claims, 6 Drawing Sheets

ELECTROSTATIC INK JET RECORDING APPARATUS PREVENTING PRECIPITATION OF CHARGED PARTICULATE MATERIAL IN INK LIQUID

BACKGROUND OF THE INVENTION

1. Field of the Invention

The present invention relates to an electrostatic ink jet recording head which accomplishes recording to a recording medium by using charged particulate materials in ink, and more particularly to an electrostatic ink jet recording apparatus which prevents precipitation of charged particulate material in ink.

2. Description of the Prior Art

An electrostatic ink jet recording apparatus according to the prior art, as disclosed in PCT Publication number WO 93/11866, has an electrostatic ink jet recording head and a counter electrode arranged behind recording paper. The counter electrode is provided for generating an electric field between the recording paper and the ink jet recording head. The ink jet recording head has an ink chamber for temporarily storing ink liquid supplied from an ink tank or the like. An ejection electrode is formed at an end of the ink chamber and driven when the ink is ejected. The tip of that ejection electrode is opposite to the counter electrode. The ink liquid in the ink chamber is fed by its own surface tension to the tip of the ejection electrode, where an ink meniscus is thereby formed.

The ink liquid used with that ink jet recording head contains charged particulate material for coloring. While the charged particulate material is electrified in a positive polarity by a Zeta potential, the ink liquid maintains electric neutrality when no voltage is fed to the ejection electrode. The polarity of the Zeta potential is determined by the characteristic of the charge particulate material.

When a voltage of the positive polarity is fed to the ejection electrode, the positive potential of the ink liquid is enhanced. The charged particulate material is caused by an electric field working between the ejection electrode and the counter electrode to shift in the ink liquid toward the tip of the ejection electrode. The charge particulate material having reached the tip of the ejection electrode is strongly drawn toward the counter electrode by the electric field working between the tip of the ejection electrode and the counter electrode. When the Coulmob force between the charge particulate material at the tip of the ejection electrode and the counter electrode substantially surpasses the surface tension of the ink liquid, an agglomeration of the charge particulate material accompanied by a small quantity of liquid flies from the tip position of the ejection electrode toward the counter electrode, and adhere to the surface of the recording medium. As the agglomeration of the charge particulate material is caused by the application of a voltage to the ejection electrode to successively fly from the tip of the ejection electrode, printing is accomplished.

However, the charge particulate material of the ink liquid used in the electrostatic ink jet recording head is readily precipitated by gravity, and therefore does not distribute evenly in the ink chamber. As a consequence, charge particulates are not steadily supplied to the tip of the ejection electrode, and the quantity of the charge particulate material in the agglomeration flying from the ink ejecting position is inconstant. Accordingly, there is the problem of difficulty to accomplish steady printing.

Furthermore, when the ink liquid in the ink chamber is to be shifted toward the tip of the ejection electrode only by the ejection electrode and the counter electrode, precipitation of the charge particulate material extends the shifting time, making it difficult to achieve high-speed printing.

SUMMARY OF THE INVENTION

An object of the present invention is to eliminate the aforementioned disadvantages of the prior art, and in particular to provide an electrostatic ink jet recording apparatus capable of printing steady images.

Another object of the invention is to provide an electrostatic ink jet recording apparatus capable of high-speed printing.

According to the invention, there is provided an electrostatic ink jet recording apparatus comprising a head body and a counter electrode. The head body has an ink chamber for holding an ink liquid such as a charge sensitive ink containing charged particulate material. An ejection port is provided at one end of the head body and connecting to the ink chamber. An ejection electrode is arranged near the ejection port and fed with an ejection voltage of the same polarity as the charge characteristic of the charged particulate material. The counter electrode is arranged opposite to the ejection port via a recording medium and has a necessary electric potential for electric attraction of the charged particulate material. A pair of stirring electrodes is arranged in the direction reverse to that of the gravity of the ink chamber and fed with a stirring voltage for shifting the charge particulate material at least in the direction reverse to the direction of gravity. A voltage generating circuit is provided for generating the ejection voltage and the stirring voltage, the latter being generated before the generation of the ejection voltage.

According to the invention, the stirring voltage for generating an electric field to shift the charged particulate material in the direction reverse to that of gravity is fed to the stirring electrodes. Moreover, that stirring voltage is generated earlier than the ejection voltage. As a result, the precipitation of toner particulates is prevented before the ejection of ink, and the overall concentration of toner particulars in the ink liquid in the ink chamber is uniformized. It is thereby made possible to supply a constant quantity of toner particulates to the tip electrode section of the ejection electrode and accordingly to achieve high-quality prints free from irregularity of recording.

When one of the stirring electrodes comes into contact with the charge sensitive ink liquid, the electric potential of the ink liquid can be controlled so as to reach a sufficient level for the accomplishment of ejection, enabling the charge characteristic of the charged particulate material to be fully drawn upon. In this instance, the polarity of the D.C. voltage of the stirring electrode in contact with the ink liquid (stirring offset voltage) is made identical to the charge polarity of the charged particulate material.

Furthermore, when a stirring A.C. voltage is fed to the stirring electrodes besides the stirring offset voltage, the toner particulates can be stirred vigorously and quickly by the action of the alternating electric field.

In addition, the stirring electrodes, if they function when no pulse voltage is fed to the ejection electrode, not only are prevented from giving any adverse effect on ejection, but also can stabilize the quantity of toner particulates in the agglomerations, irrespective of the image to be recorded, by stirring consecutively during printing, and can thereby give prints of high quality.

There are two stirring electrodes: a first stirring electrode arranged in the direction of gravity of the ink chamber and provided with the stirring offset voltage, and a second stirring electrode arranged in the direction reverse thereto. Here, if the first stirring electrode is arranged also in a direction reverse to the direction of ink ejection, the charged particulate material can be shifted not only in the direction reverse to the direction of gravity but also in the direction of ink ejection. This arrangement enables the charged particulate material to be rapidly shifted in the direction of ink ejection.

Furthermore, the electrostatic ink jet recording apparatus according to the present invention may have an electrophoretic electrode apart from the stirring electrodes. To the electrophoretic electrode is supplied an electrophoretic voltage for shifting the charged particulate material toward the ejection hole by electrophoresis. In this case, the stirring voltage is generated before the generation of the electrophoretic voltage and of the ejection voltage.

DETAILED DESCRIPTION OF THE PREFERRED EMBODIMENTS

Figure 1:
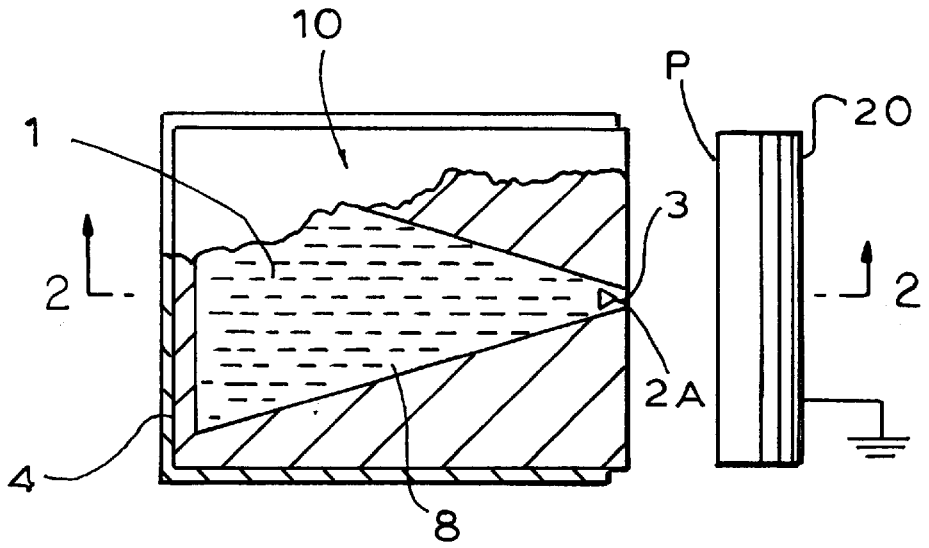
FIG. 1 is a plan of an electrostatic ink jet recording apparatus, which is a first preferred embodiment of the present invention, partly shown cross-sectionally.
Figure 2:
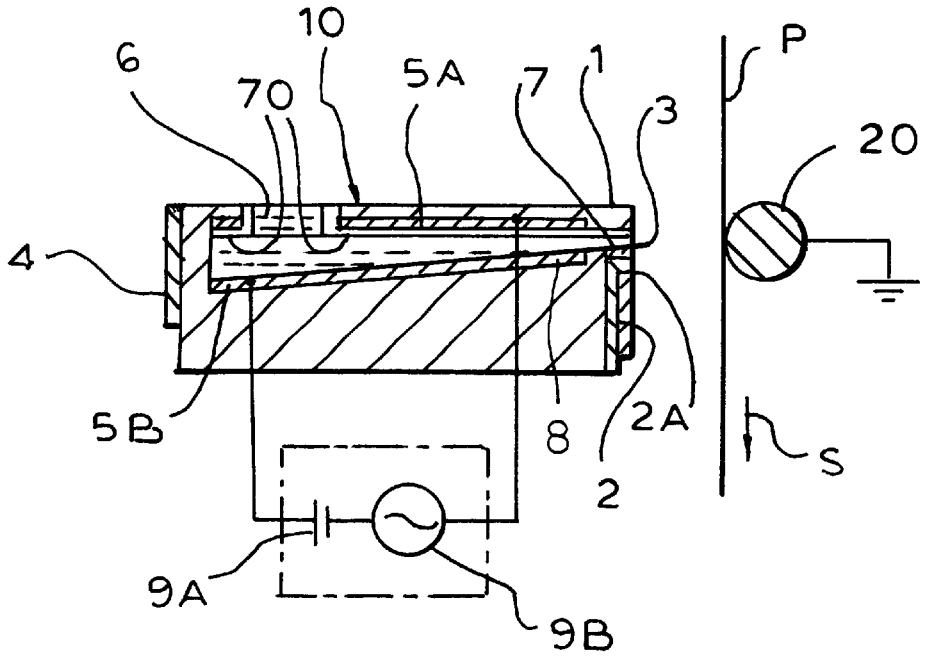
FIG. 2 shows a cross section on the X—X line in FIG. 1.

In FIGS. 1 and 2, the ink jet recording apparatus has an electrostatic ink jet recording head 10 and a counter electrode 20 arranged at a prescribed distance from the ink jet recording head 10. On the surface of the counter electrode 20 is arranged a recording medium P, which is carried by a carrying mechanism (not shown) in the direction of arrow S in FIG. 2. The counter electrode 20, consisting of an electroconductive body, is grounded so as to give its surface a potential of 0 (V).

The ink jet recording head 10 has a head body 1, an ejection electrode 2, an electrophoretic electrode 4, stirring electrodes 5A and 5B, an ink inlet 6 for feeding ink liquid, and an ink chamber 8 for storing the ink liquid. The ink liquid fed to the ink chamber 8 is a charge sensitive ink, which consists of charged particulate material (toner particulates) of thermoplastic resin, colored together with a charge control agent, dispersed in a petroleum-derived organic solvent (iosparaffin). The toner particulates are charged in an apparent positive polarity by a zeta potential. The ink inlet 6, connected to an ink tank (not shown) by a tube, feeds ink liquid into the ink chamber 8. In this process, a negative pressure of about 1 cm $H_2O$ is given to the ink liquid, which is thereby subjected to forced circulation.

The head body 1 consists of a dielectric substance, and the ink chamber 8 is formed within it. At the end of the ink chamber 8 in the ink ejecting direction is formed an ejection port, that is a minute ejection hole 3, from which part of the ink liquid is ejected. The ink chamber 8 is formed so that the cross-sectional area of its space gradually diminishes toward the ejection hole 3, underneath which is arranged the ejection electrode 2.

The ejection electrode 2 extends upward from the bottom face of the head body 1, and its tip electrode section 2A extends toward the ejection hole 3. The tip of the tip electrode section 2A is sharpened to facilitate concentration of the electric field. An insulating film 7 is formed above the tip electrode section 2A. The insulating film 7, is a protective film to prevent the ink liquid from coming into contact with the tip electrode section 2A.

The electrophoretic electrode 4 is formed by the rear face, reverse to the ink ejecting direction, and two side faces of the head body 1. The electrophoretic electrode 4 is fed with an electrophoretic voltage having the same polarity as the charge polarity of the toner particulates in the charge sensitive ink liquid. This electrophoretic voltage generates a phenomenon of electrophoresis in which the toner particulates in the ink liquid fed from the ink inlet 6 shift toward the counter electrode 20, i.e. the ejection hole 3. As the cross-sectional area of the space in the ink chamber 8 diminishes toward the ejection hole 3, the density of the toner particulates increases as they move toward the ejection hole 3.

The stirring electrodes 5A and 5B are formed respectively above and below the gravity direction of the ink chamber 8, and connected to a stirring voltage generating circuit 9. The stirring electrode 5A is formed over the ink chamber 8 reverse to its gravity direction. An insulating layer 70 covers the stirring electrode 5A so that the electrode 5A does not come into contact with the ink liquid. The Stirring electrode 5B, positioned under the ink chamber 8, is formed so as to come into contact with the ink liquid. The stirring voltage generating circuit 9, having a D.C. offset power source 9A for generating a stirring offset voltage and an A.C. power source 9B for supplying a stirring A.C. voltage, generates a voltage in which the stirring A.C. voltage is superposed over the stirring offset voltage, and feeds it between the stirring electrodes. The stirring offset voltage has the same polarity as the charge polarity of the toner particulates. The connection of the positive pole side of the stirring offset voltage to the stirring electrode 5B causes the electric field generated by the stirring offset voltage to be directed reverse to the gravity direction. This causes the positively polarized toner particulates having accumulated at the bottom of the ink chamber 2 to shift in the direction of the electric field. The stirring A.C. voltage supplied at the same time as the stirring offset voltage contributes to more efficient stirring of the toner particulates. Here, if the charge polarity of the toner particulates is reverse, this can be corrected by reversing the relationship between the positive and negative poles of the stirring offset power source 9A.

Figure 3:
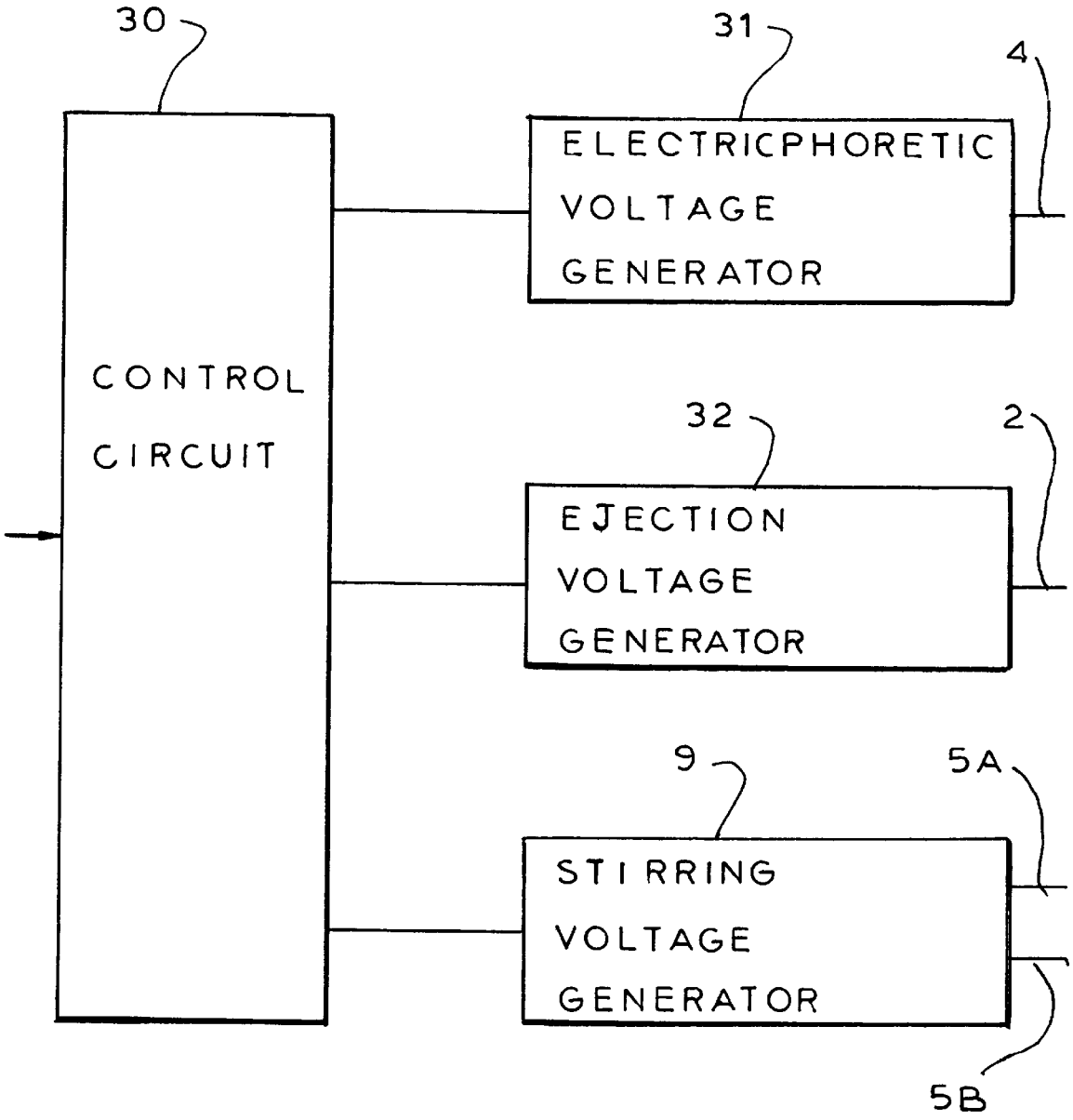
FIG. 3 illustrates the drive circuit for the ink jet recording head for the electrostatic ink jet recording apparatus of FIG. 1.

FIG. 3 illustrates the configuration of the circuit to drive the ejection electrode 2, electrophoretic electrode 4 and stirring electrodes 5A and 5B. Referring to the diagram, a control circuit 30 controls an electrophoretic voltage generating circuit 31, an ejection voltage generating circuit 32 and the stirring voltage generating circuit 9 on the basis of print data. The electrophoretic voltage generating circuit 31 generates the electrophoretic voltage to drive the electrophoretic electrode 4. The ejection voltage generating circuit 32 generates the ejection voltage to drive the ejection electorde 2. The stirring voltage generating circuit 9, as shown in FIG. 2, has the stirring offset power source 9A and the A.C. power source 9B. The electrophoretic voltage may be, for instance, 2 (kV), the ejection voltage, 1 (kV), and the stirring offset voltage from the D.C. offset power source 9A, 500 (V), and the amplitude of the stirring A.C. voltage from the A.C. power source 9B may be 1 (kV). These voltages are determined by the charge characteristic of toner particles, the distance between the ink jet recording head 10 and the counter electrode 20, and the structures of the various electrodes, but not confined to the above-stated values. The frequency of the stirring A.C. voltage from the A.C. voltage 9B, which determines the period of stirring, may be set to the experimentally optimal value.

The control circuit 30, after the start-up of the apparatus, controls the stirring voltage generating circuit 9 and the electrophoretic voltage generating circuit 31 so that the stirring voltage be fed to the stirring electrodes 5A and 5B before the electrophoretic voltage is applied to the electrophoretic electrode 4. It also controls the stirring voltage generating circuit 9 so that the stirring voltage be generated when no ejection voltage is fed to the ejection electrode in accordance with print data.

Next will be described the printing operation. When the electrophoretic voltage is fed to the electrophoretic electrode 4, an electric field is formed between the electrophoretic electrode 4 and the counter electrode 20, and electrophoresis causes toner particulates to shift toward and concentrate in the ejection hole 3. Then, when a voltage pulse is applied to the ejection electrode 2, an electric field is formed between the tip electrode section 2A of the ejection electrode 2 and the counter electrode 20, and the agglomerations of toner particulates having concentrated in the ejection hole 3 fly from there toward the counter electrode 20. The agglomerations of toner particulates which have flown adhere to the recording medium P. On the other hand, the toner particulates which have been reduced in the vicinity of the ejection hole 3 by the ejection are again shifted by electrophoresis attributable to the electrophoretic voltage toward the ejection hole 3 to be readied for consecutive ejection. Repetition of these actions causes a toner image to be formed on the recording medium P that is carried. The recording medium P on which the toner image has been formed is carried to a fixed (not shown) and thermally fixed.

Figure 4:
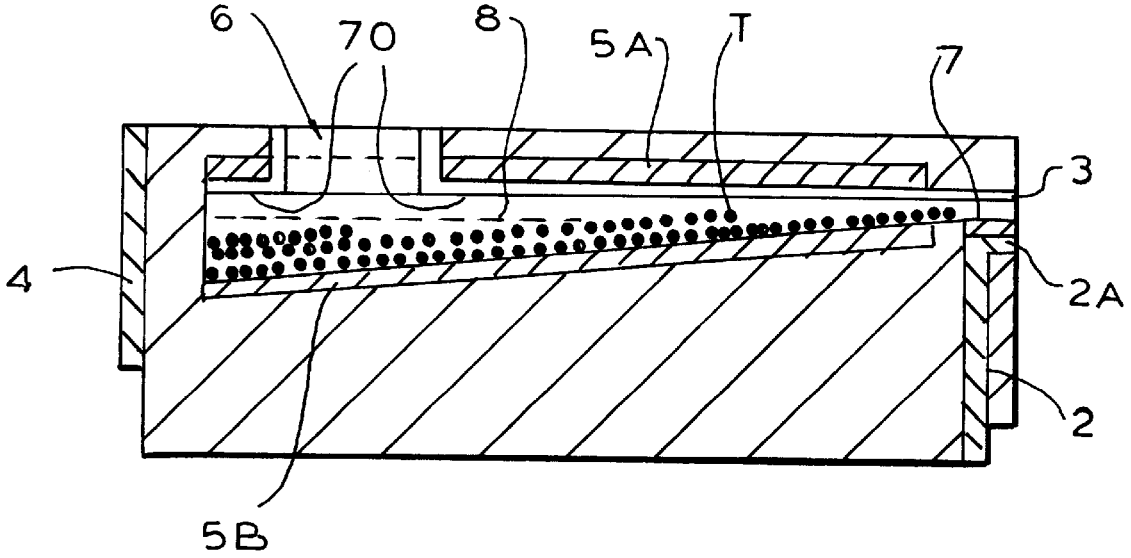
FIG. 4 shows an expanded cross-sectional view of a state in which toner particulates have precipitated in the ink chamber.

Hereupon, as the toner particulates have a greater specific gravity than the ink solvent, if they are allowed to stand for a long period of time, the toner particulates T precipitate in the ink chamber 8 as illustrated in FIG. 4. During printing, as the electrophoretic electrode 4 electrophoreses the toner particulates T to bring them together in the vicinity of the ejection electrode 2, the concentration of the toner particulates T becomes uneven in the ink chamber 8. Furthermore, since the consumption of the toner particulates T is not necessarily constant but varies with the image to be printed, the concentration of the toner particulates in the vicinity of the ejection electrode 2 is inconstant. In such a case, the toner particulates are not supplied in a uniform volume to the vicinity of the ejection electrode 2, resulting in the disadvantage that the volume of ejected toner varies with the recorded image and the printed image becomes uneven.

Figure 5:
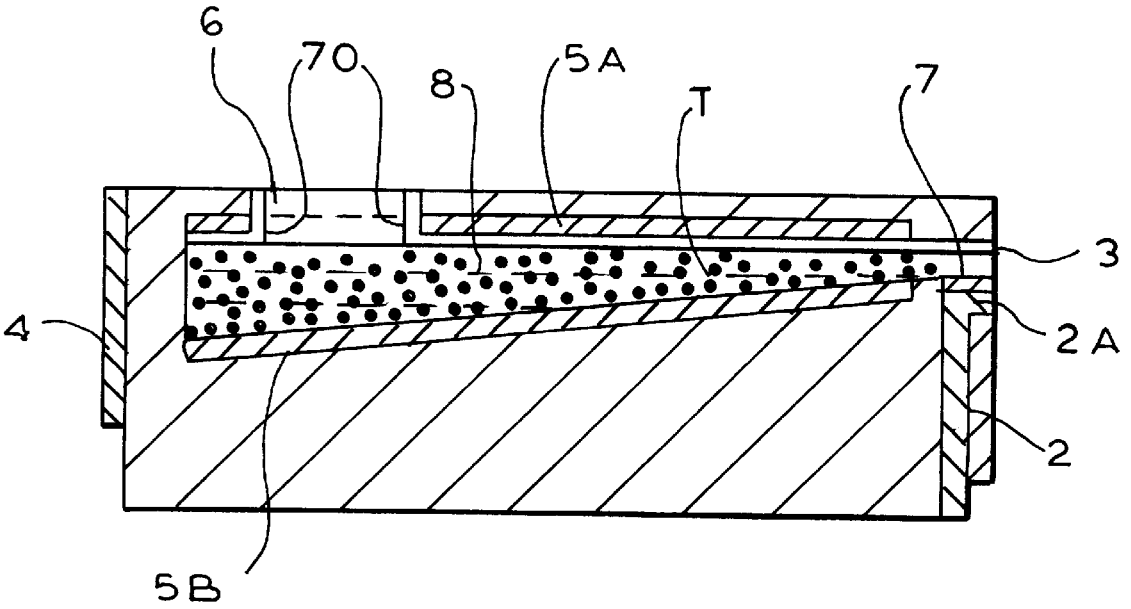
FIG. 5 shows a cross-sectional view of the state of toner particulates in the ink chamber when a voltage is applied to the stirring electrodes.
Figure 6:
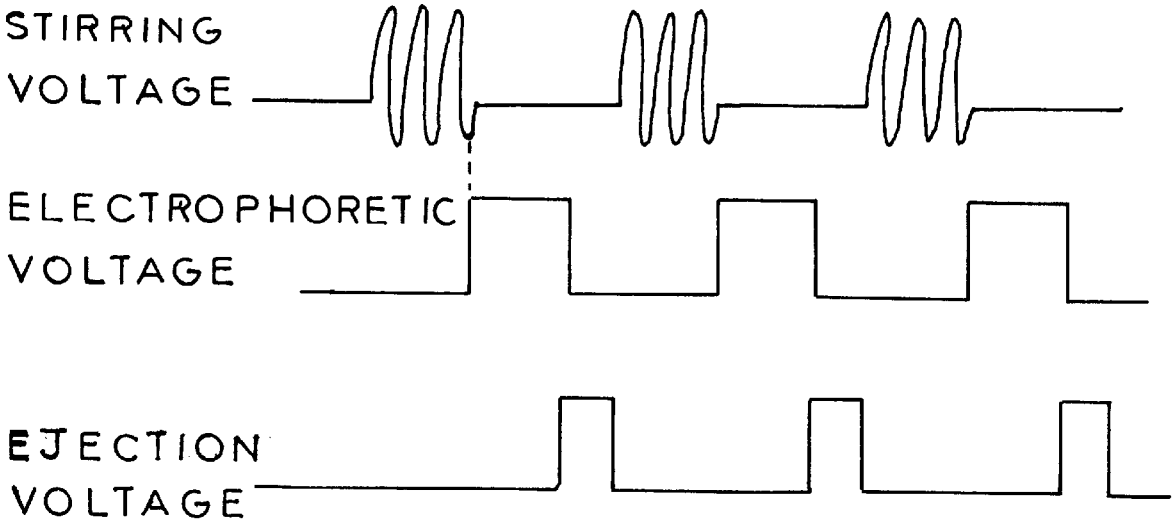
FIG. 6 is a timing chart illustrating the operation of the drive circuit of FIG. 3.
Figure 7:
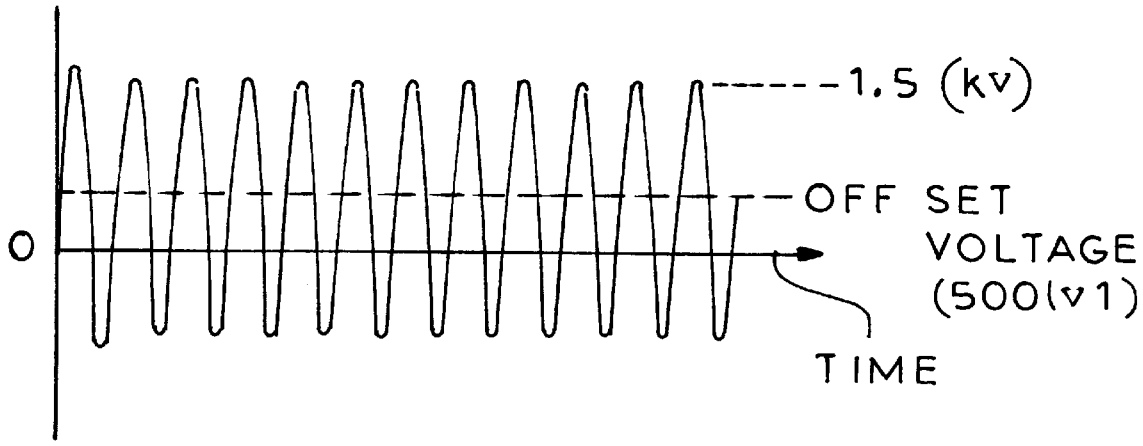
FIG. 7 is a waveform diagram illustrating in a continuous form the stirring voltage shown in FIG. 6.

In view of this problem, in this preferred embodiment of the invention, the stirring voltage generating circuit 9 feeds the stirring voltage to the stirring electrodes 5A and 5B before the electrophoretic voltage is applied to the electrophoretic electrode 4, as shown in FIG. 6. The stirring voltage, as shown in FIG. 7, consists of the stirring A.C. voltage, 1 (kV) on a peak-to-peak basis, superposed over the stirring offset voltage, 500 (V). This causes an alternating electric field in the gravity direction to be formed in the ink chamber 8, and the toner particulates T which have precipitated therein soar as illustrated in FIG. 5. To describe this stirring action in more detail, the toner particulates T are shifted in the direction reverse to the gravity direction by the stirring offset voltage fed from the D.C. offset power source 9A in FIGS. 2 and 3 to the stirring electrodes 5A and 5B. Simultaneously with the stirring offset voltage, the stirring A.C. voltage is applied, and the toner particulates T rapidly shift contrary to the gravity direction while the A.C. voltage is high and in the gravity direction while the A.C. voltage is low (while its polarity is reverse). This process efficiently stirs the toner particulates T having precipitated and accumulated in the ink chamber 8, and their concentration is generally uniformized, too. After the application of this stirring voltage, the electrophoretic voltage is fed to the electrophoretic electrode 4, and the resultant electrophoresis shifts the toner particulates T in the direction of ink ejection and, after that, the ejection voltage causes the agglomerations of ink particulates to fly from the ejection hole 3.

As shown in FIG. 6, when printing is to be done, although the stirring voltage, electrophoretic voltage and ejection voltage generate in that order, the electrophoretic voltage may be supplied to the electrophoretic electrode 4 while the ejection voltage is being supplied to the ejection electrode 2. Further, if the stirring voltage is generated earlier than the electrophoretic voltage, the generating period of the electrophoretic voltage and that of the stirring voltage may partly overlap each other.

As so far described, in this preferred embodiment of the invention, the stirring electrodes 5A and 5B are fed with the stirring voltage to generate an electric field which has the same polarity as the toner particulates and shifts them contrary to the gravity direction. As a result, the toner particulates are prevented from precipitating, and their concentration in the charge sensitive ink liquid in the ink chamber is generally uniformized. This enables a uniform quantity of toner particulates to be supplied to the tip electrode section 2A of the ejection electrode 2, resulting in high-quality prints with no irregularity of recording. As the stirring electrodes 5A and 5B are also fed with the stirring A.C. voltage in addition to the stirring offset voltage, the toner particulates can be vigorously and rapidly stirred by the action of the resultant alternating electric field.

Moreover, as the stirring electrodes 5A and 5B function when no pulse voltage is applied to the ejection electrode, they not only have no adverse effect on the ejecting action but also consecutively perform stirring during the printing process. This serves to stabilize the quantity of toner particulates in the agglomerations irrespective of the image to be recorded, and enables high-quality prints to be obtained.

Furthermore, since the stirring voltage is generated before the application of the electrophoretic voltage to the electrophoretic electrode 4, the toner particulates are dispersed by the stirring, and the dispersed toner particulates can be quickly carried by electrophoresis to the ejection hole 3. It is thereby made possible to carry the right amount of toner particulates to the ejection hole 3 more smoothly than when they have precipitated, restrain unevenness of ejection, realize high print quality, and accomplish steady high-speed printing by the continuous ejection of toner particulates.

Figure 8:
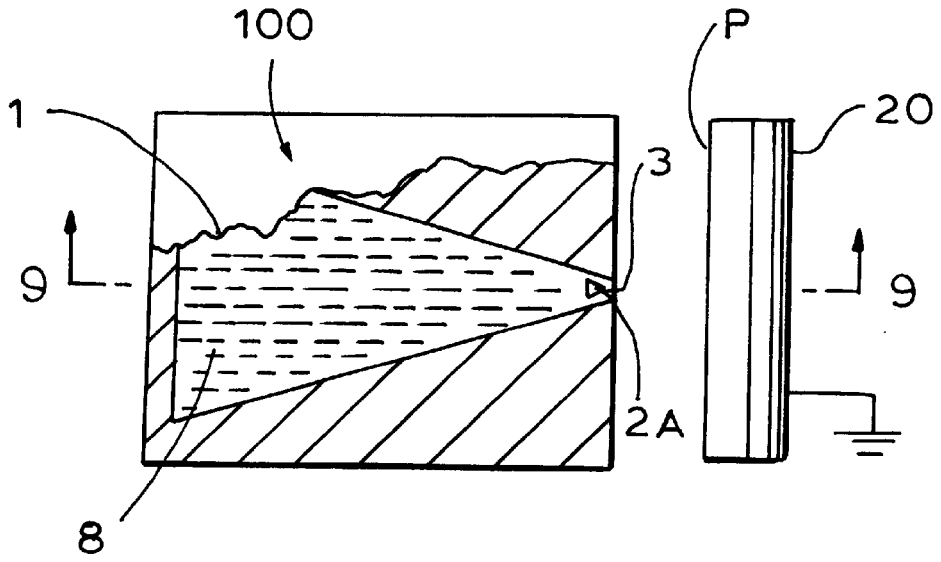
FIG. 8 is a plan of an electrostatic ink jet recording apparatus, which is a second preferred embodiment of the invention, partly shown cross-sectionally.
Figure 9:
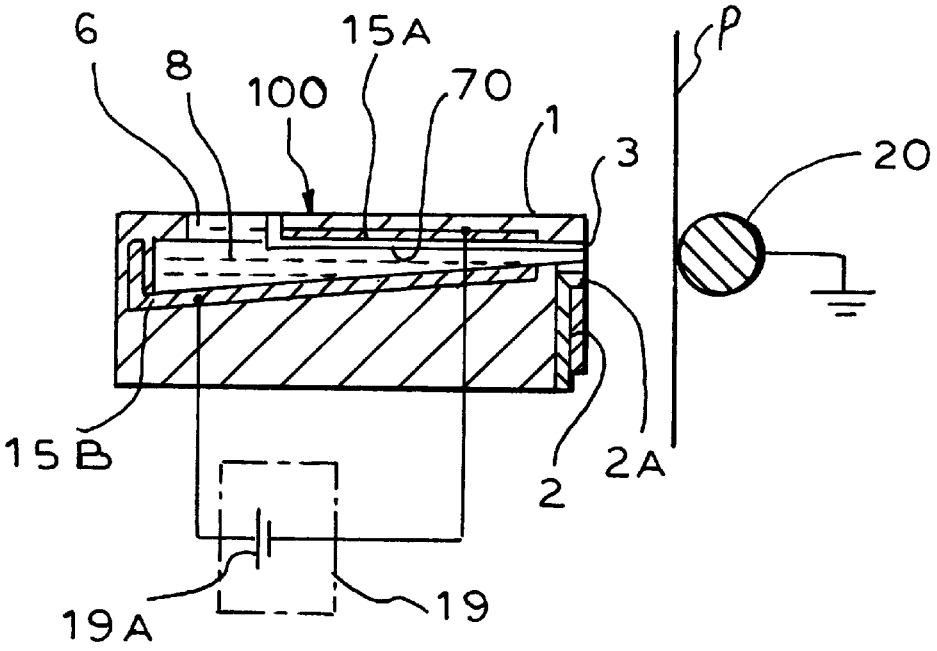
FIG. 9 shows a cross section on the Y—Y line in FIG. 8.

In the electrostatic ink jet recording apparatus illustrated in FIGS. 8 and 9, which is a second preferred embodiment of the present invention, an ink jet recording head 100 dispenses with the electrophoretic electrode 4 of the ink jet recording head 10 of FIGS. 1 and 2, and a stirring electrode 15B extends to a position opposite to the ejection hole 3. A stirring electrode 15A, arranged in a position opposite to the stirring electrode 15B with respect to the gravity direction, is formed from the ink inlet 6 to the vicinity of the ejection hole 3. A stirring electrode generating circuit 19 has a stirring offset power source 19A, and a stirring A.C. power source is dispensed with. In other respects, this embodiment has the same configuration as the above-described first embodiment.

As a stirring offset voltage, 1 (kV), is fed to the stirring electrodes 15A and 15B, the toner particulates which have precipitated therein soar, to become dispersed in the ink and uniformized. Since the stirring electrode 15B is formed not only on the bottom side of the ink chamber 8 but also on the face opposite to the ejection hole 3, the toner particulates in the vicinity of the ink inlet 6 shift toward the ejection hole 3 and the stirring electrode 15A. Accordingly, the stirring electrode 15B performs both the role of the stirring electrode 5B in FIG. 1 and that of the electrophoretic electrode to shift the toner particulates in the direction of ink ejection.

Thus, the ink jet recording head 100 can not only realize dispersion and uniformization of toner particulates and high-speed printing as does the ink jet recording head 10 of the first embodiment, but also can be reduced in cost commensurately with the absence of the electrophoretic voltage generating circuit and the A.C. power source for stirring.

Figures 10A, 10B:
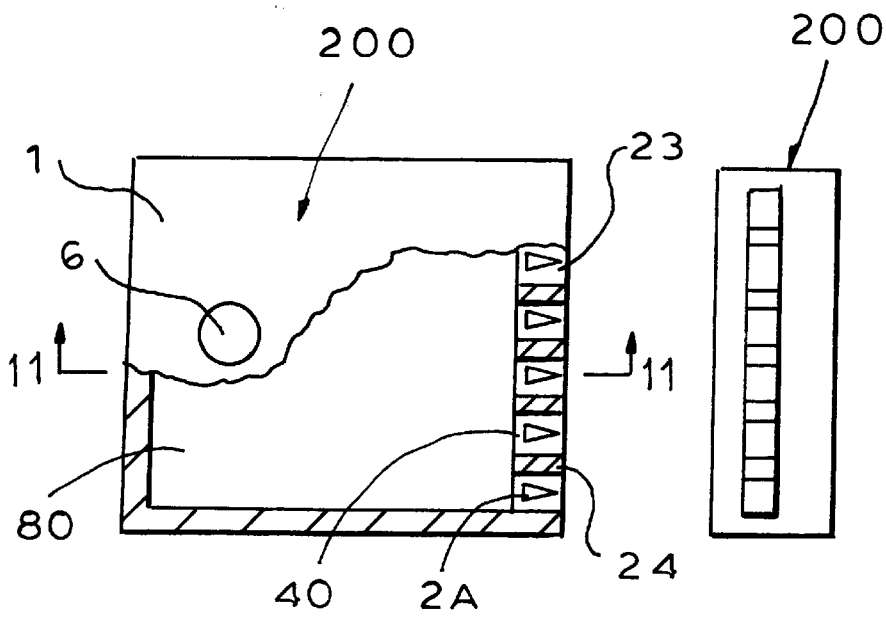
FIG. 10A is a plan of an electrostatic ink jet recording apparatus, which is an alternative version of the second preferred embodiment of the invention, partly shown cross-sectionally.
FIG. 10B shows a profile of the electrostatic ink jet recording apparatus of FIG. 10A.
Figure 11:
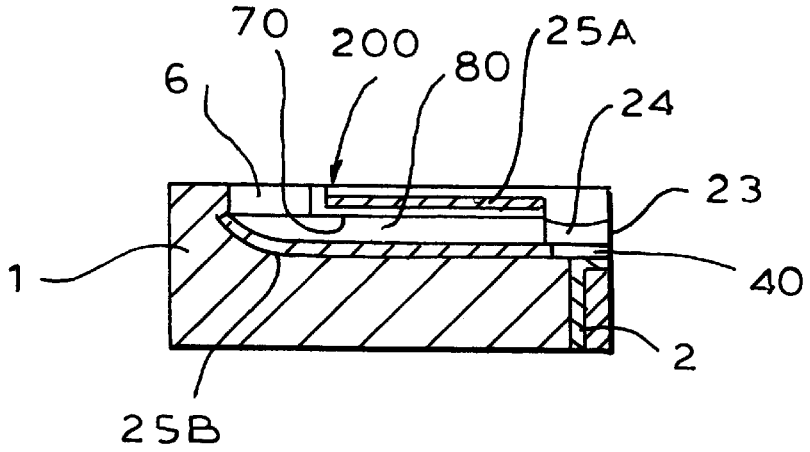
FIG. 11 shows a cross section on the Z—Z line in FIG. 10A.

The present invention is not limited to the preferred embodiments described above. For instance, the shapes of the ink chamber 8 and the ejection hole 3 are not confined to those used in the first and second embodiments. As illustrated in FIGS. 10A and 10B, an ink jet recording head 200 may have a plurality of ejection holes 23 arranged at regular intervals with partitions 24 in-between. In an ink chamber 80, unlike the ink chamber 8 in FIG. 1, the cross-sectional area of the space within does not converge toward the ejection holes. As shown in FIG. 11, the face of the ink chamber 80 opposite to the ejection holes 23 is formed in a flat or curved shape, slanted with respect to the gravity direction. This makes it difficult for toner particulates in the charge sensitive ink liquid to accumulate in the vicinity of the ink inlet.

On the bottom of the ink chamber 80 is formed an insulating film 40, underneath which is formed a stirring electrode 25B. The stirring electrode 25B and the insulating film 40 are formed from the ink inlet 6 to the vicinity of the ejection electrode 2. As the insulating film 40 simultaneously insulates the ejection electrode 2 and the stirring electrode 25B from the ink liquid, there is the advantage of simplifying the manufacturing process. When the stirring offset voltage is fed to the stirring electrodes 25A and 25B, toner particulates having precipitated and accumulated on the bottom of the ink chamber 80 soar, and are dispersed in the ink and uniformized. As the stirring electrode 25B is formed not only on the bottom side of the ink chamber 80 but also on its face opposite to the ejection holes 23, the toner particulates in the vicinity of the ink inlet 6 shift toward the plurality of ejection holes 23 and the stirring electrode 25A. Therefore, the stirring electrode 25 plays both the role of the stirring electrode 5B and that of the electrophoretic electrode in FIG. 1.

What is claimed is:

1. An electrostatic ink jet recording apparatus comprising:

a voltage generator which generates an ejection voltage having a first polarity and a stirring voltage, said stirring voltage being different from said ejection voltage;

an ink jet recording head which comprises a head body having an ink chamber for holding an ink liquid;

an ejection port provided in said head body and connecting to said ink chamber through which an ink liquid is ejected in an ink ejecting direction;

an ejection electrode arranged near said ejection port such that when said ink chamber contains an ink liquid containing charged particulate material having a first polarity and when said ejection electrode is fed with said ejection voltage, at least a portion of the ink liquid contained in said ink chamber is caused to be ejected through said ejection port;

a counter electrode arranged opposite to said ejection port and having a necessary potential for electric attraction of charged particulate material ejected through said ejection port; and a first stirring electrode and a second stirring electrode arranged in said ink jet recording head such that when said ink chamber contains an ink liquid containing charged particulate material having said first polarity and when said stirring voltage is applied between said first and second stirring electrodes, an electric field is generated in said ink chamber to shift the charged particulate material in said ink cavity away from said first stirring electrode and toward said second electrode in a direction opposite to gravity.

2. An electrostatic ink jet recording apparatus as claimed in claim 1, wherein said voltage generator includes an ejection voltage generator to generate said ejection voltage and a stirring voltage generator to generate said stirring voltage; and said stirring voltage generator generates as said stirring voltage a D.C. voltage having said first polarity.

3. An electrostatic ink jet recording apparatus as claimed in claim 2, wherein said stirring voltage generator generates a stirring voltage comprising said D.C. voltage over which an A.C. voltage is superposed.

4. An electrostatic ink jet recording apparatus as claimed in claim 2, wherein said stirring voltage is generated when said ejection voltage is not generated.

5. An electrostatic ink jet recording apparatus as claimed in claim 1, wherein said first and second stirring electrodes are positioned such that when said ink chamber contains an ink liquid containing charged particulate material and when said stirring voltage is applied between said stirring electrodes, the charged particulate material in said ink chamber is caused to shift away from said first stirring electrode and toward said second stirring electrode in a direction opposite the direction of gravity, and wherein said first stirring electrode is further positioned in said ink jet recording head opposite to said ejection port and said ink ejection direction such when said first and second stirring electrodes are fed with said stirring voltage, said charged particulate material in said ink chamber is additionally shifted in said ink ejecting direction.

6. An electrostatic ink jet recording apparatus, as claimed in claim 5, wherein the side of said ink chamber opposite to said ejecting port is inclined with respect to the direction of gravity.

7. An electrostatic ink jet recording apparatus as claimed in claim 1, further comprising:

an electrophoretic electrode to which an electrophoretic voltage is supplied to shift said charged particulate material to said ejecting port by electrophoresis, said electrophoretic electrode being formed in said ink jet recording head; and wherein said voltage generator separately generates said ejection voltage, said electrophoretic voltage and said stirring voltage, and wherein said stirring voltage is generated before generation of said electrophoretic voltage and said ejection voltage.

8. An electrostatic ink jet recording apparatus, as claimed in claim 7, wherein said stirring voltage is a D.C. voltage having said first polarity.

9. An electrostatic ink jet recording apparatus, as claimed in claim 8, wherein said stirring voltage comprises of said D.C. voltage over which an A.C. voltage is superposed.

10. An ink jet recording head, comprising:

a head body having an ink chamber for holding an ink liquid;

an ejection port provided in said head body and connecting to said ink chamber through which an ink liquid is ejected in an ink ejecting direction;

an ejection electrode arranged near said ejection port such that when said ink chamber contains an ink liquid containing charged particulate material and when said ejection electrode is fed with an ejection voltage, at least a portion of the ink liquid contained in said ink chamber is caused to be ejected through said ejection port; and a first stirring electrode and a second stirring electrode arranged in said head body such that when said ink chamber contains an ink liquid containing charged particulate material and when a stirring voltage is applied between said first and second stirring electrodes, an electric field is generated in said ink chamber to shift the charged particulate material in said ink cavity away from said first stirring electrode and toward said second stirring electrode in a direction opposite to gravity.

11. An ink jet recording head as recited in claim 10, wherein said first stirring electrode is further positioned in said head body opposite to said ejection port and said ink ejecting direction such that when said ink chamber contains an ink liquid containing charged particulate material and when said first and second stirring electrodes are fed with a stirring voltage, the charged particulate material in said ink chamber is additionally shifted in said ink ejecting direction.

12. Apparatus, comprising:

an ink jet head having an ink chamber for holding an ink;

an ejection port formed in said head and connected to said ink chamber in such a manner that when an ink is located in said ink chamber, at least a portion of said ink can be ejected from said ink chamber through said ejection port;

an ejection field generator which intermittently applies an ejection electric field in the area of said ejection port in such a manner that when a charge sensitive ink is located near said ejection port, at least a portion of said charge sensitive ink will be ejected through said ejection port; and a stirring electric field generator having a first stirring electrode and a second stirring electrode and which applies an AC electric field in said ink chamber prior to the application of said ejection electric field so as to stir any charge sensitive ink which is located in said ink chamber by alternatingly shifting said charge sensitive ink in a first direction away from said first stirring electrode and toward said second stirring electrode and then in a second direction opposite said first direction, said first direction being opposite the direction of gravity and said second direction being in the same direction as gravity.

13. Apparatus according to claim 12, wherein said AC electric field is a DC biased electric field.

14. Apparatus according to claim 12, wherein said ejection electric field is a pulsed field.

15. Apparatus according to claim 14, wherein said AC electric field is a DC biased electric field.

16. Apparatus according to claim 12, wherein said ejection field generator comprises an ejection electrode located near said ejection port and a power source for applying an intermittent electric current to said ejection electrode.

17. Apparatus according to claim 16, wherein said ejection field generator further comprises a counter electrode located opposite said ejection port to attract said portion of said charge sensitive ink.

18. Apparatus according to claim 12, wherein said stirring electric field generator further includes a power source for applying an alternating signal across said first and second stirring electrodes.

19. Apparatus according to claim 18, wherein said alternating signal is a DC biased AC signal.

20. Apparatus according to claim 18, wherein said stirring electrodes are located on opposite sides of said ink chamber.

21. Apparatus according to claim 20, wherein said stirring electrodes each have a primary surface which extends in a direction substantially perpendicular to the direction of gravity.

22. Apparatus according to claim 21, wherein at least one of said stirring electrodes has a secondary surface which extends in a direction substantially parellel to the direction of gravity.

23. Apparatus according to claim 21, wherein the primary surface of at least one of said stirring electrodes further extends along a surface of said ink chamber which is substantially opposite said ejection port.

24. Apparatus according to claim 12, further including means for moving any charge sensitive ink located in said ink chamber towards said ejection port.

25. Apparatus according to claim 12, further including an electrophoretic field generator which applies an electric field in an area of said ink chamber in such a direction that when a charge sensitive ink is located in said ink chamber, at least a portion of said charge sensitive ink located in said ink chamber will be moved towards said ejection port.

26. Apparatus according to claim 25, wherein said electrophoretic field generator comprises an electrophoretic electrode and a power source for applying an electric current to said electrophoretic electrode prior to the application of said ejection electric field and after the application of said AC electric field.

27. Apparatus according to claim 26, wherein said electrophoretic electrode is located at least on a side of said ink chamber which is opposite said ejection port.

28. A method, comprising the steps of:

providing an ink jet head having an ink chamber, an ejection port connected to said ink chamber, a first electrode and a second electrode each in contact with said ink chamber, said ink chamber containing a charge sensitive ink;

stirring said charge sensitive ink by applying an alternating electric field to said ink such that said charge sensitive ink is alternatingly caused to shift away from said first electrode toward said second electrode in a direction opposite the direction of gravity, and then away from said second electrode toward said first electrode in the same direction as gravity; and ejecting at least a portion of said ink through said ejection port by applying an ejection electric field, wherein said ejecting step is performed after said stirring step.

29. The method according to claim 28, wherein said ink is additionally stirred so as to be shifted toward said ejection port.

30. The method according to claim 28, wherein said stirring step is performed by applying an alternating electric signal across said first and second electrodes to generate said alternating electric field.

31. The method according to claim 30, wherein said first and second electrodes are located on opposite sides of said ink chamber so that said alternating electric field is applied across said ink chamber.

32. The method according to claim 28, further comprising the step of shifting said ink toward said ejection port.

33. The method according to claim 32, wherein said shifting step is performed concurrently with said stirring step.

34. The method according to claim 32, wherein said shifting step is performed after said stirring step and before said ejection step by applying an electrophoretic electric field to said ink.

35. The method according to claim 34, wherein said shifting step is performed by applying said electrophoretic electric field in a pulsed manner.

36. The method according to claim 28, wherein said alternating electric field is generated by superimposing an AC voltage over a DC offset voltage.

37. The method according to claim 28, wherein said ejecting step is performed by applying said ejection electric field in a pulsed manner.

* * * * *